US006887347B2

(12) United States Patent
Ponomarenko et al.

(10) Patent No.: US 6,887,347 B2
(45) Date of Patent: May 3, 2005

(54) CELLULOSE FIBERS COMPRISING RADIATION ACTIVATABLE RESIN FORMALITIES

(75) Inventors: Ekaterina Ponomarenko, Bad Soden am Taunus (DE); Ludwig Busam, Huenstetten (DE)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 10/730,659

(22) Filed: Dec. 8, 2003

(65) Prior Publication Data

US 2004/0140070 A1 Jul. 22, 2004

Related U.S. Application Data

(63) Continuation of application No. PCT/US02/17978, filed on Jun. 7, 2002.

(30) Foreign Application Priority Data

Jun. 8, 2001 (EP) ..... 01113956

(51) Int. Cl.[7] ..... D06M 10/00; D06M 15/21; D06M 10/106; D21H 25/02

(52) U.S. Cl. ..... 162/9; 162/157.1; 162/168.1; 162/135; 162/169; 8/116.1

(58) Field of Search ..... 162/9, 157.6, 158, 162/135–137, 164.1, 164.6, 169, 168.1, 168.2, 168.3, 164.3; 427/361, 391; 8/115.51, 115.6, 116.1, 181, 116.4

(56) References Cited

U.S. PATENT DOCUMENTS

| | | | | | |
|---|---|---|---|---|---|
| 3,224,926 | A | | 12/1965 | Bernardin | |
| 3,241,533 | A | | 3/1966 | Balmer | |
| 3,440,135 | A | | 4/1969 | Chung | |
| 3,658,613 | A | | 4/1972 | Steiger | |
| 3,756,913 | A | | 9/1973 | Wodka | |
| 3,819,470 | A | | 6/1974 | Shaw et al. | |
| 3,853,592 | A | * | 12/1974 | Crawford et al. | 430/536 |
| 3,883,557 | A | * | 5/1975 | Farber et al. | 549/225 |
| 3,932,209 | A | | 1/1976 | Chatterjee | |
| 3,987,968 | A | | 10/1976 | Moore et al. | |
| 4,035,147 | A | | 7/1977 | Sangenis et al. | |
| 4,420,368 | A | * | 12/1983 | Drach | 162/8 |
| 4,689,118 | A | | 8/1987 | Makoul et al. | |
| 4,737,559 | A | | 4/1988 | Kellen et al. | |
| 4,748,044 | A | | 5/1988 | Fottinger et al. | |
| 4,822,453 | A | | 4/1989 | Dean et al. | |
| 4,853,086 | A | | 8/1989 | Graef | |
| 4,889,595 | A | | 12/1989 | Herron et al. | |
| 4,935,022 | A | | 6/1990 | Lash et al. | |
| 5,026,806 | A | | 6/1991 | Rehmer et al. | |
| 5,137,537 | A | | 8/1992 | Herron et al. | |
| 5,183,707 | A | | 2/1993 | Herron et al. | |
| 5,190,563 | A | | 3/1993 | Herron et al. | |
| 5,212,040 | A | * | 5/1993 | Sanders et al. | 430/126 |
| 5,492,733 | A | * | 2/1996 | D'Anna et al. | 427/517 |
| 5,549,791 | A | | 8/1996 | Herron et al. | |
| 5,587,261 | A | | 12/1996 | Audett et al. | |
| 5,800,884 | A | * | 9/1998 | D'Anna et al. | 428/35.7 |
| 5,998,511 | A | | 12/1999 | Westland et al. | |
| 6,090,236 | A | | 7/2000 | Nohr et al. | |
| 6,184,271 | B1 | | 2/2001 | Westland et al. | |

FOREIGN PATENT DOCUMENTS

| | | | | | |
|---|---|---|---|---|---|
| DE | 3836370 | A1 | | 5/1990 | |
| EP | 0024703 | A1 | | 3/1981 | |
| EP | 0246848 | A2 | * | 11/1987 | C09J/3/14 |
| EP | 0 427 316 | A2 | | 5/1991 | |
| EP | 0 705 365 | B1 | | 4/1996 | |
| EP | 1264930 | A1 | * | 12/2002 | D06M/10/00 |
| JP | 1995-96561 | | | 10/1995 | |
| JP | 1996-006252 | A | | 1/1996 | |
| WO | WO 921132 | A2 | * | 7/1992 | G03C/3/00 |
| WO | WO 98/27262 | A1 | | 6/1998 | |
| WO | WO 99/30843 | A1 | | 6/1999 | |
| WO | WO 99/45879 | A1 | | 9/1999 | |

OTHER PUBLICATIONS

English Abstract of DE 3836370 A1.*
English Abstract of EP 0024703 A1.*

* cited by examiner

*Primary Examiner*—José A. Fortuna
(74) *Attorney, Agent, or Firm*—Eric T. Addington; Dara M. Kendall; Ken K. Patel

(57) ABSTRACT

The present invention relates to cellulosic fibrous material comprising a radiation activatable resin, structures comprising such fibrous material, and absorbent articles especially disposable absorbent articles, comprising such fibrous materials or structures. It further relates to a process to make such fibrous material, structures or articles.

24 Claims, No Drawings

CELLULOSE FIBERS COMPRISING RADIATION ACTIVATABLE RESIN FORMALITIES

FIELD OF THE INVENTION

The present invention relates to cellulosic fibrous material comprising a radiation activatable resin, structures comprising such fibrous material, and absorbent articles especially disposable absorbent articles, comprising such fibrous materials or structures. It further relates to a process to make such fibrous material, structures or articles.

BACKGROUND OF THE INVENTION

Cross-linked cellulose for use in absorbent articles is well known and is disclosed as such in EP-A-0.427.316 (Herron), U.S. Pat. No. 5,549,791 (Herron), WO 98/27262 (Westland), or U.S. Pat. No. 6,184,271 (Westland). While cross-linked cellulose fibers exhibit useful properties and have found broad commercial applications, there remains a need for improving such fibers especially with regard to allowing better balancing of brittleness and resiliency properties of such fibers. While stiffness is often desired to allow for maintenance of an open structure such as for improved liquid handling, stiffness is often linked to increased brittleness of the fibers, creating, for example, undesired break up during the transport of the fibers from the fiber making and fiber treatment plant to the fiber user.

In order to improve on these problems, the present invention relates to the application of radiation activatable resins to the cellulose fibers and, upon application of the radiation, to fiber comprising cross-linked radiation activatable resin.

Radiation curable resins are known in the art and have been disclosed in DE-38 36 370 (Hintze; BASF), or U.S. Pat. No. 5,026,806 (Rehmer; BASF), wherein UV cross-linkable materials based on (meth-) acrylic acid ester or co-polymers thereof are described in particular for being used in hotmelt (contact) adhesives and sealing compounds. Application of photo-curable resins to optical fibers has been disclosed e.g., in WO 99/30843, and the application to non-woven webs is described in U.S. Pat. No. 4,748,044. Further, photocurable, cellulose based compositions are known, which are derived from cellulose based materials, such as described in JP2298501 (Shin Etsu), or JP-08006252 (Sony), the latter relating to a general-purpose photosensitive resin composition. In U.S. Pat. No. 6,090,236 (Nohr), a process is described to create coatings for a web by radiation induced polymerization of monomeric or oligimeric materials.

However, so far it has not been contemplated to exploit radiation induced cross-linking of polymeric material in the context of cellulosic fibers.

Henceforth, the present invention aims at providing cellulose based fibers comprising a radiation activatable cross-linking or curing resin, at structures and especially absorbent articles comprising such fibers, as well as at the methods of making such fibers or structures.

In a particular embodiment, the present invention provides an improved process for handling cellulosic fiber material, especially when this fiber material is being transported or stored during the overall handling, with improved fiber properties resulting from such handling as compared to conventional transporting or storage.

SUMMARY OF THE INVENTION

The present invention relates to fibrous material comprising cellulosic fibers, whereby the fibers comprise a polymeric resin with covalently bonded radiation reactive groups, which are capable of forming cross-linking bonds upon being impacted by radiation energy. The cellulose based fibers can be crimped, curled, and are preferably flash-dried fibers. Preferably, the polymeric resin has a glass transition temperature ($T_g$) of more than 30° C., preferably 50° C., when cross-linked to a degree of cross-linking of at least 85%, and the radiation activatable groups are selected from the group consisting of benzophenone, anthraquinone, benzyl, xanthones, preferably from the group of benzophenones. Preferably, the polymeric resin has a polymeric backbone with monomers selected from the group of ethylene; propylene; vinyl chloride; isobutylene; styrene; isoprene; acrylonitrile; acrylic acid; methacrylic acid; ethyl acrylate; methylmethacrylate; vinyl acrylate; allyl methacrylate; tripropylene glycol diacrylate; trimethylol propane ethoxylateacrylate; epoxy acrylates; polyester acrylates; and urethane acrylates.

The radiation energy for impacting on said polymeric resin is preferably UV, or IR light, more preferably UV light, and even more preferably UV light with a wavelength of between 200 nm and 280 nm.

In addition to the radiation activatable groups, the fibers can have a second cross-linking chemical or chemical group, capable of forming cross-linking bonds without being impacted by radiation energy. This second cross-linker group is preferably selected from the group consisting of aldehyde and urea-based formaldehyde; carboxylic acid, preferably C2–C9 polycarboxylic acids that contain at least three carboxyl groups, preferably from the group consisting of citric acid, tartaric acid, malic acid, succinic acid, glutaric acid, citraconic acid, itaconic acid, tartrate monosuccinic acid, maleic acid, poly(acrylic acid), poly(methacrylic acid), poly(maleic acid), poly(methylvinylether-co-maleate) copolymer, poly(methylvinyl ether-co-itaconate copolymer, copolymers of acrylic acid, and copolymers of maleic acid. The cross-linking can be between cellulose molecules of the same or of different cellulosic fibers. The present invention also relates to a fibrous aggregate, such as a web, comprising fibers as described in the above, and this web can have essentially uniform or different, optionally patterned, degree of cross-linking.

The fibers or the aggregates are particularly useful and beneficial as being used as a liquid handling material, and more particular as a material for acquisition and/or distribution in absorbent bodies, such as disposable absorbent articles.

The present invention further relates to a method for treating cellulosic fibers having the steps of providing cellulosic fibers; forming fiber aggregates; applying a radiation activatable resin to the fibers; curing of the radiation activatable resin, whereby the step of providing cellulosic fibers is executed before the step of forming fiber aggregates. In addition to these essential steps, the method can further have the optional steps of forming an intermediate web; disintegrating the intermediate web; applying a non-radiation activatable material; curing of said non-radiation activated cross-linking material; or transporting said fibers, web, or aggregates. One or more of the process steps may be repeated. The radiation activatable resin can be selectively applied to a predetermined region of the formed fiber aggregate or can be selectively applied to predetermined regions of the formed fiber aggregates at predetermined varying levels.

DETAILED DESCRIPTION OF THE INVENTION

Cellulosic fibers of diverse natural origin are applicable to the invention. Although available from various sources such as Esparto grass, bagasse, hemp, flax, and other lignaceous and cellulosic fiber containing sources, preferred cellulosic fibers are derived from wood pulp, especially digested fibers from softwood, hardwood or cotton linters. Suitable wood pulp fibers for use with the invention can be obtained from well-known chemical processes such as the Kraft and sulfite processes, with or without subsequent bleaching. The pulp fibers may also be processed by thermomechanical, chemi-thermo-mechanical methods, or combinations thereof. The preferred pulp fiber is produced by chemical methods. Ground wood fibers, recycled or secondary wood pulp fibers, and bleached and unbleached wood pulp fibers can be used. The preferred starting material is prepared from long fiber coniferous wood species, such as southern pine, Douglas fir, spruce, and hemlock. Details of the production of wood pulp fibers are well-known to those skilled in the art. These fibers are commercially available from a number of companies, such as from Weyerhaeuser Company, Washington, US, under the designations CF416, NF405, PL416, FR516, or NB416.

The fibers may be supplied in slurry, unsheeted or sheeted form. Fibers supplied as wet lap, dry lap or other sheeted form can be rendered into unsheeted form by mechanically disintegrating the sheet. The fibers can be provided in a wet or moistened condition, or can be never-dried fibers. In the case of dry lap, the fibers can be moistened prior to mechanical disintegration in order to minimize damage to the fibers.

The fibers can further be treated such as to provide curl, crimp, or twist to the fibers, such as resulting from mechanical defibration, or —as a preferred method—from so-called "flash drying" as being well known in the art, such as described in U.S. Pat. No. 5,549,791 (Herron), or U.S. Pat. No. 3,987,968.

The fibers can further be treated with cross-linking agents, which are not radiation activatable but rather allow cross-linking under conventional conditions such as thermal treatment. Such agents are also referred to as second cross-linking materials and non-radiation activatable cross-linking agents. Such cellulose cross-linking agents include crosslinking agents known in the art such as aldehyde and urea-based formaldehyde addition products. See, for example, U.S. Pat. Nos. 3,224,926, 3,241,533, 3,932,209, 4,035,147, 3,756,913, 4,689,118, 4,822,453, 3,440,135, 4,935,022, 4,889,595, 3,819,470, 3,658,613, 4,853,086. Other suitable cross-linking agents include carboxylic acid crosslinking agents such as polycarboxylic acids. U.S. Pat. Nos. 5,137,537, 5,183,707, and 5,190,563 describe the use of C2–C9 polycarboxylic acids that contain at least three carboxyl groups (e.g., citric acid and oxydisuccinic acid) as crosslinking agents. Suitable urea-based cross-linking agents include substituted ureas such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Suitable polycarboxylic acid crosslinking agents include citric acid, tartaric acid, malic acid, succinic acid, glutaric acid, citraconic acid, itaconic acid, tartrate monosuccinic acid, and maleic acid. Other polycarboxylic acid crosslinking agents include polymeric polycarboxylic acids such as poly (acrylic acid), poly(methacrylic acid), poly(maleic acid), poly(methylvinylether-co-maleate) copolymer, poly (methylvinyl ether-co -itaconate copolymer, copolymers of acrylic acid, and copolymers of maleic acid. The use of polymeric polycarboxylic acid crosslinking agents such as polyacrylic acid polymers, polymaleic acid polymers, copolymers of acrylic acid, and copolymers of maleic acid is described in U.S. Pat. No. 5,998,511. Mixtures or blends of crosslinking agents can also be used.

Once applied, the crosslinking agents can be treated in conventional ways to affect crosslinking. For example, the cross-linking agents can be heated at a temperature and for a time sufficient to cure the crosslinking agent and to provide a crosslinked fibrous material. Another method for effecting crosslinking is to treat the fibrous material treated with the cross-linking agent with a crosslinking catalyst and then optionally heating the resulting web to cure the crosslinking agent. Another conventional method for crosslinking a fibrous material or a web that includes fibers involves adjusting the pH of the web to facilitate the crosslinking reaction.

Cross-linking chemicals suitable as radiation activatable resins are generally of a polymeric structure, having a polymeric backbone and radiation activatable groups (i.e., certain chemical groups become chemically active—and hence reactive—only upon irradiation). The term radiation refers in the general context of the present invention to any radiation, such as electron-beam radiation, or electromagnetic radiation, especially UV—or IR radiation. The resin can further comprise other reactive sites suitable for reacting with the cellulosic molecules of the cellulosic fibers or—for example—conventional cross-linking.

Upon irradiation, the radiation activatable groups form radicals which then can bond to cellulosic molecules of the cellulosic fibers or to other molecules of the resin itself, such as of the polymeric backbone, thereby forming a cross-linked polymeric network.

After the radiation initiated reaction is terminated, there will generally be some of the network structure with some unreacted sites, specifically some unreacted radiation activatable groups. Preferably, the reaction is carried out to achieve high degrees of cross-linking, preferably to at least 50%, more preferably to at least 70% and even more preferably to at least 85% of the radiation activatable groups. Further, it is preferred that the cross-linking reaction is predominantly done such that it includes radiation activatable groups (i.e., that there are not too many reactions such as between molecules of the polymeric backbone or other, non-radiation activatable groups). Preferably, at least 80% or more preferably at least 90% of the created bonds include radiation activatable groups, as evaluated by $^{13}$C-NMR.

Radiation activatable groups suitable for the present invention are well known in the art as free radical-generating photoinitiators. The predominate group is carbonyl compounds, such as ketones, especially α-aromatic ketones. Examples of α-aromatic ketone photoinitiators include, by way of illustration only, benzophenones; xanthones and thioxanthones; α-ketocoumarins; benzyls; α-alkoxydeoxybenzoins; benzyl ketals or α,α-dialkoxydeoxybenzoins; benzoyldialkylphosphonates; acetophenones, such as α-hydroxycyclohexyl phenyl ketone, α,α-dimethyl-α-hydroxyacetophenone, α,α-dimethyl-α-orpholino-4-methzylthioacetophenone, α-ethyl-α-benzyl-α-dimethylaminoacetophenone, α-ethyl-α-benzyl-α-dimethylamino-4-morpholinoacetophenone, α-ethyl-α-benzyl-α-dimethylamino-3,4-dimethoxyacetophenone, α-ethyl-α-benzyl-α-dimethylamino4-methoxyacetophenone, α-ethyl-α-benzyl-α-dimethylamino-4-imethylaminoacetophenone, α-ethyl-α-benzyl-α-dimethylamino4-methylacetophenone, α-ethyl-α-(2-propenyl)-α-dimethylamino-4-morpholinoacetophenone, α,α-bis(2-propenyl)-α-dimethylamino-4-morpholinoacetophenone,α-methyl-α-benzyl-α-dimethylamino-4-orpholinoacetophenone, and α-methyl-α-(2-propenyl)-α-dimethylamino-4-morpholinoacetophenone; α,α-dialkoxyacetophenones;

α-hydroxyalkylphenones; O-acyl α-oximino ketones; acylphosphine oxides; fluorenones, such as fluorenone, 2-t-butylperoxycarbonyl-9-fluorenone, 4-t-butylperoxycarbonyl-nitro-9-fluorenone, and 2,7-di-t-butylperoxycarbonyl-9-fluorenone; and α- and α-naphthyl carbonyl compounds. Other free radical-generating photo-initiators include, by way of illustration, triarylsilyl peroxides, such as triarylsilyl t-butyl peroxides; acylsilanes; and some organometallic compounds. The free radical-generating initiator desirably will be selected from the group consisting of acetophenones, 4,4'-bis(N, N'- dimethylamino) benzophenones, 9,10 (phen)-anthraquinone, benzyl, ((2-chloro-) thio-) xanthones, and even more preferably benzophenones.

Suitable backbone polymers can be made from a wide variety of monomers such as ethylene; propylene; vinyl chloride; isobutylene; styrene; isoprene; acrylonitrile; acrylic acid; methacrylic acid; ethyl acrylate; methyl-methacrylate; vinyl acrylate; allyl methacrylate; tripropylene glycol diacrylate; trimethylol propane ethoxylateacrylate; epoxy acrylates, such as the reaction product of a bisphenol A epoxide with acrylic acid; polyester acrylates, such as the reaction product of acrylic acid with an adipic acid/hexanediol-based polyester; urethane acrylates, such as the reaction product of hydroxypropyl acrylate with diphenylmethane-4,4'-diisocyanate; and polybutadiene diacrylate oligomer.

Preferred backbone materials exhibit an after polymerization $T_g$ of more than 20° C., preferably of more than 30° C., and even more preferably of more than 50° C.

Radiation activatable groups and backbones can be combined for example to form (meth)acrylate copolymers and monoethylenically unsaturated aromatic ketones, which are crosslinkable by ultraviolet light such as described for the use in contact adhesives in U.S. Pat. No. 4,737,559. Other materials which are crosslinkable by ultraviolet radiation under atmospheric oxygen and are based on (meth)acrylate copolymers and contain copolymerizable benzophenone derivatives or acetophenone derivatives, are further detailed in U.S. Pat. No. 5,026,806. This chemistry has further advantages over the one as described in U.S. Pat No. 4,737,559 as it can be crosslinked in the air (rather than under inert atmosphere), and allows application which is free of solvents and unsaturated monomers.

Further suitable radiation activatable resin is an acrylic copolymer combined with a chemically built-in photoinitiator of the benzophenone type, such as commercially available for self-adhesive applications from BASF AG, Ludwigshafen, Germany, under the designation acResin®, adjusted to exhibit a $T_g$ of at least about 30° C. For particular applications, such polymers may include hydrophilizing agents, such as hydrophilic groups grafted to the polymeric backbone, or so called surfactants applied to the surface.

While the resins useful for the present invention can be activated by any kind of radiation, such as electron beams or infra-red light, preferred executions can be activated by UV light. More preferably, the resins exhibit an activation profile as a function of the wavelength of the radiation, so as to allow better control of the reaction process, and to minimize pre- and/or post-curing such as through ambient (e.g., solar) radiation.

Preferably, the radiation activatable resin is oxygen stable in that the resin is neither oxygen activated nor oxygen inhibited, so as to allow easier operation without the need for an inert atmosphere.

The radiation activatable resins are preferably compatible with other additives and/or applications aids, and non-reactive therewith. The resins can be soluble in solvents, and are preferably soluble or suspendable in aqueous liquids.

For the discussion within the present context, the terms "curing" and "cross-linking", or "curable" and "cross-linkable" can generally be used interchangeably, and refer to a chemical reaction bonding of two active sites of two molecules to each other. In the present context, the thusly connected molecules are generally polymeric molecules. This refers to the fact, that the reaction is generally not taking place between the monomers or oligomers of the "backbone" of the resins as discussed hereinafter, but that the cross-linking reaction occurs predominantly between already formed polymeric chains, thusly creating a polymeric network rather than creating polymers by the radiation activated polymerization.

As the curing reaction should be predominantly activated by the radiation and not by thermal effects, the radiation activated reactions should be completed to a sufficient degree, before the radiation impact increases the temperature so as to also induce thermally triggered, conventional cross-linking reactions.

In many applications, it is particularly preferred, that the cured and reacted resins are stable to further radiation or other reactions conditions such as temperature, pressure, and/or hydrolysis conditions. Further, for many applications it will be desired, that the reacted resins do not exhibit residual stickiness or tack.

A process for the treatment of cellulose fibers by radiation curable resins according to the present invention will include certain process features, as known in the art.

It is well known to a skilled person how to provide cellulosic fibers as described in the above. Thus the fibers can be delivered in an individualized form in that the fibers are essentially suspended in a carrier means such as gas or a liquid, and do not form an aggregate as described hereinafter. In the context of the cellulose fiber production plant, the fibers maybe in the form of an aqueous slurry or in a gas suspended form, such as for pneumatically transported fibers, or a fluidized bed.

Further, the fibers may be treated fibers by having an increased degree of twist, crimp, and curl, and/or by comprising a conventional (i.e., non-radiation activatable) cross-linking resin, optionally in a reacted or unreacted condition.

It will also be well known to a skilled person that cellulosic fibers can be formed into a fiber aggregate structure by various means or processes. As used herein, the term "fiber aggregates" refers to a structure comprising fibers, which are in contact with each other so as to form this structure. The contact between adjacent fibers can be established such as based on mechanical effects, such as friction or entanglement, or chemical effects, such as hydrogen bonding, or cross-linking (which would be referred to as "inter-fiber cross-linking", which can be achieved by conventional ways of cross-linking, as discussed separately hereinafter, or by radiation curable cross-linking according to the present invention) or the like. The contact can also be established such as by a binding means, such as adhesives, binder resins, or the like. The result of such aggregation is often referred to as webs, or sheets, or bales, and the process steps to form such aggregates in general are known to a skilled person.

Such aggregates can have a wide range of shapes, forms, densities or thickness. For a preferred application in the field of absorbent articles, the aggregates will preferably have basis weights of less than about 800 $g/m^2$ and densities of less than about 0.60 $g/cm^3$. Other applications contemplated for the fibers of the present invention include low density webs having densities which may be less than about 0.03 g/cm$^3$.

Cellulosic fiber aggregates can be further processed to be directly combined with other elements to form articles—such as absorbent articles.

Cellulosic fiber aggregates can also be formed into an intermediate web, such as rolls, spools, or boxed or baled structures, which allow easier interim storage and/or transport, so as to allow use of such aggregates at different sites than the manufacturing sites of the aggregates. A particular example is the forming of wet laid rolls of cellulosic material, which then can be shipped to a "converter site" where absorbent articles are manufactured comprising the cellulosic material. During this manufacturing, that aggregates may remain in their original structure and are inserted into the article upon cutting.

The aggregates may also be further disintegrated, such as by well known means such as hammer-mills, or bale openers, or re-slurrying and so on. Thereafter, a further aggregate forming step as discussed in the above will be used to form the final aggregate, now often in a web form.

In addition to process steps well known as such, radiation activatable resins as discussed in the above are applied to the cellulose fibers. To this effect, the cellulosic fibers need to be brought in contact with the respective radiation activatable resins. While certain forms of application may provide particular benefits for certain types of radiation activatable resins, a particular form of application has not been found to be critical for the present invention.

Application can be achieved while the cellulosic fibers are individualized or while these fibers are in an aggregate form, such as a web. If the fibers are in a defibrated state, they can be in a low density, individualized, fibrous form known as "fluff", as discussed in the above.

The resin may be applied to the fibers by means of a carrier or solvent liquid, such as an aqueous solution or dispersion comprising the resin. The carrier liquid and the resin can then be contacted with the fiber by generally known methods, including forming an aqueous slurry of the fibers and adding the resin, optionally by the means of the carrier, to the slurry. Upon removal of the liquid carrier, the resin can deposit on the fibers or actually penetrate into the fiber. The resin may be applied to the fibers while they are in an essentially individualized state, such as by being suspended in an air stream, such as by spraying the resin with or without a carrier. The fibers may be formed into a structure, such as bales or sheets, and the prior to treatment with the reactive agents, following methods as described hereinafter in the context of forming webs.

As used herein, "effective amount" refers to an amount of agent sufficient to provide an improvement in at least one significant absorbency property of the fibers themselves and/or absorbent structures containing the crosslinked fibers, relative to uncrosslinked fibers. As will be readily apparent to a skilled person, the amount of the agent will depend on chemical composition with regard to the amount of radiation activatable groups relative to the backbone polymer. The resin may amount to 20% by weight of the total weight of fibers and resin (and thus excluding a carrier, if used). Although, partially for economic reasons, smaller amounts of resin such as less than about 15% are preferred, while often more than about 0.5%, preferably more than 1% and often more than 5% will be required so as to provide sufficient degree of cross-linking.

After the radiation activatable resins have been applied to the cellulose fibers, the resins need to be submitted to radiation suitable to activate the cross-linking reaction as described herein before for the resins as such.

The radiation useful to activate the cross-linking reaction is dependent upon the particular chemistry of the reagents, and may be electromagnetic (including visual light, UV-A, B, C, or IR) or electron-beams as has been discussed in the above.

A preferred execution is the use of UV-light, and even more preferred is the use of UV-C light, such as having a wavelength of from about 200 nm to about 280 nm, in particular, when the radiation activatable groups are benzophenone groups. However, UV-A light in the range of 315 nm to 400 nm may also be used advantageously. A particular benefit of using such wavelengths lies in readily available equipment (i.e., mercury-vapor lamps such as commercially available from IST Metz GmbH, Nuertingen, Germany, such as providing between 160 W/cm of length of lamp and 200 W/cm, using mercury vapor as being particularly suitable for UV-C sensitive reagents, or using iron doped metal halides for UV-A/B sensitive materials). Furthermore, radiation activatable groups may exhibit insensitivity to visual/sun-light, such that no particular precautions with regard to preventing of undesired reaction need to be taken during or after radiating for the reaction.

The energy level required to perform the respective reaction is dependent upon the particular chemistry, upon the degree of desired cross-linking, and upon the amount of material treated per time and/or area unit. Further, energy level depends on the relative positioning of the fibers and the radiation emitting element, i.e., the lamps. Generally, it has been found that the radiation intensity is highly important for executing the reaction, such that by applying high radiation intensities for short periods good reaction completeness can be achieved without straining other material properties, such as color, by high energy input.

There can be various relative positions between the fibers which are to be radiated, and the radiation emitting source (e.g., lamps). For example, if the fibers are positioned in a layered (web) arrangement, there will be a certain penetration of the radiation into the web, which can be used for a desired degree of cross-linking. If this would not be desired, other arrangements can be chosen, such as having fibers moving freely in a radiated duct. The apparatus may further comprise mirrors to distribute the radiation more evenly or to focus the radiation to certain regions.

In one embodiment, the crosslinking agent is caused to react with the fibers in the substantial absence of interfiber bonds, i.e., while interfiber contact is maintained at a low degree of occurrence relative to unfluffed pulp fibers, or the fibers are submerged in a solution that does not facilitate the formation of interfiber bonding, especially hydrogen bonding. Alternatively, if desired, the cross-linking can be used to create inter-fiber crosslinking.

Apart from optional repetition of any of the described process steps, further steps can be added that may provide further benefits to the materials, products, or processes.

In particular, when it is desired to not only have radiation activated cross-linking, conventional cross-linking can be included by application of a crosslinking agent to the fibers, which is not radiation curable and submitting such treated fibers to cross-linking conditions without the application of radiation, such as thermal treatment.

Further, when forming the fibrous material, a further process step can be the addition of other materials to the cellulosic fibers, such as synthetic fibers, or particulate materials, such as powders or granules. In order to still maintain the predominantly cellulosic fiber dominated properties of the fibrous material, the amount of the added material should not be excessive, and typically will not exceed 50% of the total fibrous material.

Added synthetic fibers can be made from a variety of polymers, including thermoplastic polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and the like. Suitable fibers may also be made from superabsorbent material, such as well known in the art. Depending on the particular intended application, suitable fibrous materials may include hydrophobic fibers that have been made hydrophilic, such as by incorporating hydrophilizing agents into the resin, or by treating the surface. Suitable thermoplastic fibers can be made from a single polymer (monocomponent fibers), or can be made from more than one polymer (e.g., bicomponent fibers such as sheath/core fibers). The length of the synthetic fibers can vary over a wide range, and typically, these thermoplastic fibers have a length from about 0.3 to about 7.5 cm, preferably from about 0.4 to about 3.0 cm, and most preferably from about 0.6 to about 1.2 cm. The diameter of these thermoplastic fibers is typically defined in terms of either denier (grams per 9000 meters) or decitex (grams per 10,000 meters). Suitable thermoplastic fibers can have a decitex in the range from about 1.0 to about 20, preferably from about 1.4 to about 10, and most preferably from about 1.7 to about 3.3.

The fibrous material may further comprise particulate material, which may be added for enhancing the strength properties of the web, and can be polymeric particles, optionally partially molten so as to provide a binder function. Such particles may be added for enhancing fluid handling properties, such as when using so called superabsorbent materials, or may be added for improving gas or odor adsorption properties. Thus suitable particles may be made of partially cross-linked polyacrylate, silica, zeolites or any other natural or synthetic material. The individual particle size is typically not larger than about 1000 $\mu$m, and it will often be desired for handling and dust related reasons limited amounts of particles smaller than about 50 $\mu$m.

A particular aspect of the present invention relates to the order of the various process steps. In the above, the following process steps were identified:

providing cellulosic fibers;

forming fiber aggregates;

forming an intermediate web;

disintegrating the intermediate web applying a radiation activatable resin;

curing of said radiation activatable resin;

applying a non-radiation activatable cross-linking agent;

curing of said non-radiation activatable cross-linking agent;

transporting the fibers, web, or aggregate; and addition of other materials.

Out of these steps, providing cellulosic fibers, forming fiber aggregates, applying a radiation activatable resin, and curing of said radiation activatable resin are considered to be essential process steps for executing the present invention; the remaining steps as well as repetition of certain steps are considered optional. While the above steps are not listed in the order as they could be executed in the treatment process, certain of these steps have a certain relative order. Particularly, the application of the radiation activatable resin needs to be executed before the radiation curing takes place. Likewise, the application of the non-radiation activatable cross-linking agent needs to be executed before the non-radiation curing. Also, the disintegration of the intermediate web can only be executed after the intermediate web has been formed.

The process according to the present invention can be executed by applying the radiation curable resin to the fibers at any stage of the fiber handling process, and it also allows the radiation activation to be executed at any stage thereafter.

For example, conventional fluff pulp fibers can be treated with the radiation activatable resin, either in a fluffed state or when being formed into an aggregate or a web, and can be radiation cured while the individualized fluff is further conveyed through an activation pipe, wherein it is radiated.

Consequently, in such a process, the cross-linking can be applied evenly to all individualized fibers. The radiation can also be applied to a web formed from fibers to which the radiation activatable resin has been applied, or to a web formed from fibers without resin being added to the fibers, but added to the web as such. In either case, the radiation can be applied to the web such that a homogeneous cross-linking is achieved. Homogeneous cross-linking can be performed by controlling the thickness of the web such that the radiation can penetrate sufficiently into the web. The radiation can also be applied selectively to predetermined portions of the web, such that particular property profile can be designed into the web (e.g., creating a cross-linking profile through the thickness dimension of a web). Considering a web which is to be introduced into an absorbent article in the liquid loading receiving region, the web may exhibit a higher degree of cross-linking either by application of more radiation activatable resin or of more radiation, thereby imparting better gush handling properties. Other regions of the web further remote from the liquid loading receiving region preferably exhibit better liquid retention properties achieved by a lesser degree of cross-linking (i.e., application of less radiation activatable resin or of less radiation).

In one particular embodiment, the present invention relates to a process including the transport of fibers from one location to another, such as from the pulp mill to an article production site. In the context of this discussion, "transport" refers to an operation where the fibers are in an aggregate form allowing non-continuous transport such as in rolls or bales or bags, but also an interim storage. Thus, the direct transport (such as in continuous piping system within one production site or between subsites of one site) would be excluded under this term, but the conveying into an interim storage bin decoupling the fiber delivery from the fiber removal from that bin would be included under the term transport with interim storage.

Considering conventional cross-linking technologies, such as discussed in the background section, the cross-linking is formed at the pulp producing site, and the cross-linked fibers are transported to the converter site for further processing, such as forming articles, such as absorbent articles. However, during the transport, the fibers may often lose the modified properties achieved by cross-linking. For example, when using the fibers in absorbent articles, it is often desired that the cross-linking step improves the liquid handling properties of the fibers and the webs made thereof, or of the articles comprising such fibers. Often this improvement is achieved by modifying the fibers towards better wet and dry resiliency or stiffness under a load. Also, in order to get a more open structure, the fibers have been modified towards higher bulk, such as by imparting twist, crimp, and curl to the cellulosic fibers.

Transport of the fibers is made more difficult because of the risk of fiber damage during the transport, which would result in the fibers losing some of the benefits as imparted by the treatment (i.e., cross-linking and twisting). Known attempts to address this problem involve low density packaging, such as in a bale form at a lower density than conventional wet laid roll forming. A further approach has been described in EP-A-0705365 (STORA), wherein an alcohol can be added to the fibers thus facilitating transport between the site of application of the cross-linker resin and the site of the cross-linking step. However, since conventional cross-linking agents often require thermal treatment to activate the cross-linking, the process after the transporting step requires significant effort from an equipment point of view. Also, the addition of the alcohols can impact the properties of the fibers and/or of the resulting webs or products.

For such circumstances, the present invention allows alternative process configurations by better and easier application of the cross-linker resins more independently from the curing step.

The step of the addition of other materials, such as other fibers, or particles, can be introduced into the process at many points depending on the type of materials, including the combination with the cellulosic fibers before the radiation activatable resin is added or thereafter. If the resin is applied to the fibrous material after the non-cellulosic material has been added, the resin may also react with parts of the added material, or may react on the surface of such materials.

A preferred process for treating cellulose fibers comprises the steps of (in terms of the reference to the process step list in the above) in the following order:

providing the cellulosic fiber at the fiber production site, such as a pulp mill;

applying the radiation activatable resin to the fibers at the same site;

forming an intermediate web at the fiber production site, such as in roll for, or bale form;

transporting the intermediate web to an article manufacturing plant, such as a diaper plant;

disintegrating the fibers;

curing the fibers by radiation treatment;

forming the final web and combining it to an article.

In a modification of this process, the step of curing the fibers may be executed after the final web has been formed.

A further preferred process option would additionally include conventional crosslinking at the pulp mill production site, such that the order of process steps would be as follows:

providing the cellulosic fiber at the pulp mill production site;

applying the radiation activatable resin to the fibers at the same site;

applying the non-radiation activatable resin to the fibers;

heat treating the fibers so as to cure the non-radiation activatable resin;

forming an intermediate aggregate at the fiber production site such as in roll or bale form;

transporting the intermediate aggregate to a converter plant, such as a diaper plant;

disintegrating the fibers;

curing the fibers by radiation treatment;

forming the final web and combining it to an article.

As a modification to this process, the step of curing the fibers may be executed after the final web has been formed. Also, the application of the radiation activatable resin and the non-radiation activatable resin can be done simultaneously in one step, for example by adding one resin including radiation activatable groups as well as conventional cross-linking groups.

Yet another preferred process option would comprise the following order of process steps:

providing the cellulosic fiber at the pulp mill production site;

applying a first radiation activatable resin to the fibers at the same site;

curing the fibers by a first ration treatment;

forming an intermediate web at the pulp mill, such as in roll or bale form;

transporting the intermediate web to a converter plant, such as a diaper plant;

disintegrating the fibers;

applying a second radiation activatable resin to the fibers;

curing the fibers by second radiation treatment;

forming the final web and combining it to an article.

Yet a further preferred process option includes application of conventional non-radiation activatable cross-linking agents at the pulp mill production site, and both radiation activatable resin application and curing at the converter side, such that the order of process steps would be as follows:

providing the cellulosic fiber at the pulp mill production site;

applying a non-radiation activatable cross-linking agent to the fibers;

heat treating the fibers so as to cure the non-radiation activatable resin;

forming an intermediate web at the pulp mill, such as in roll for, or bale form;

transporting the aggregate to a converter plant, such as a diaper plant;

disintegrating the fibers;

applying a radiation activatable resin to the fibers at the same site;

curing the fibers by radiation treatment;

forming the final web and combining it to an article.

As a modification of this process, the step of curing the fibers may be executed after the final web has been formed.

As also done in conventional processes, an additional drying step, preferably a flash drying step, can be performed between the application of the non-radiation activatable cross-linking agent and the conventional (i.e., non-radiation activated) curing. This step could provide increased twist and curl of the fibers so as to improve liquid handling functionality.

Fibers according to the present invention exhibit beneficial performance properties, such as when evaluated upon being formed into a web suitable for testing, for example at densities and basis weights suitable for use in articles such as absorbent articles.

In particular, such webs can be evaluated according to the Capillary sorption test, as described in the test method section of WO 99/45879. The webs preferably exhibit "Capillary Sorption Desorption Height" (sometimes also referred to as "Medium Desorption Pressure" ) at which the material has released 50% (CSDH 50) of its capacity at 0 cm (CSAC 0) of less than 20 cm, more preferably of less than 17 cm and most preferably of less than 15 cm. Such webs preferably have an overall uptake value, as measured by the same test method as the Capillary Sorption Absorbent Capacity at a height of 0 cm (CSAC 0), of more than 10 g/g, more preferably of more than 12 g/g and most preferably more than 14 g/g, wherein the unit g/g indicates units of grams of fluid per gram of material.

It further has been found, that fibers according to the present invention exhibit a lower loss of brightness during cross-linking, as compared to fibers cross-linked by conventional cross-linking methods, as described before. In particular, when using ISO Standards 2469 "Paper, board, and pulps—Measurement of diffuse reflectance factor," 2470 "Paper and Board—Measurement of Diffuse Blue Reflectance Factor (ISO Brightness)" and 3688 "Pulps—Measurement of Diffuse Blue Reflectance Factor (ISO Brightness)," fibers cross-linked by methods according to the present invention exhibit a loss in brightness of less than about 7%, and preferably less than about 3% (i.e., fiber brightness is reduced from 83% for untreated fibers to values higher than 76%, and preferably higher than 80%). Conversely, conventional cross-linking conditions can result in brightness losses of more than 7% (i.e., fiber brightness is reduced from 83% for untreated fibers to values less than 76%).

While fibers treated according to the present invention can be used for a broad field of applications, such as filtration fiber, fillings, insulation and the like, a preferred use is for liquid handling materials especially for use in absorbent articles (e.g., disposable diapers for babies and/or adults, feminine care articles, and the like).

It has been found that the cross-linked fibers of the present invention can be used to make absorbent cores with substantially improved fluid handling properties including, but not limited to, liquid acquisition rate, liquid distribution rate, and interim liquid storage capacity relative to equivalent density absorbent cores made from conventional un-cross-linked fibers or from prior known cross-linked fibers. Furthermore, these improved absorbency results may be obtained in conjunction with increased levels of wet resiliency. The term "wet resilience," in the present context, refers to the ability of a moistened pad to spring back towards its original shape and volume upon exposure to and release from compression forces. Compared to cores made from untreated cellulosic fibers, and prior known cross-linked fibers, the absorbent cores made from the fibers of the present invention will regain a substantially higher proportion of their original volumes upon release of wet and dry compression forces.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Fibrous material comprising cellulosic fibers, wherein said fibers comprise a polymeric resin comprising covalently bonded radiation reactive groups capable of forming cross-linking bonds upon being impacted by radiation energy, wherein said cellulosic fibers are curled, crimped, or twisted.

2. The fibrous material according to claim 1, wherein said polymeric resin has a glass transition temperature of more than 30° C. when cross-linked to a degree of cross-linking of at least 85%.

3. The fibrous material according to claim 1, wherein said radiation activatable groups are selected from the group consisting of benzophenone, anthraquinone, benzyl, xanthones, and mixtures thereof.

4. The fibrous material according to claim 1, wherein said resin comprises a polymeric backbone comprising monomer molecules selected from the group of ethylene; propylene; vinyl chloride; isobutylene; styrene; isoprene; acrylonitrile; acrylic acid; methacrylic acid; ethyl acrylate; methylmethacrylate; vinyl acrylate; allyl methacrylate; tripropylene glycol diacrylate; trimethylol propane ethoxylateacrylate; epoxy acrylates; polyester acrylates; urethane acrylates; and mixtures thereof.

5. The fibrous material according to claim 1, wherein said polymeric resin is applied in amounts of less than 50% by weight of fibers and resin in the unreacted state.

6. The fibrous material according to claim 1, wherein said polymeric resin is applied in amounts of more than 0.25% in its reacted state.

7. The fibrous material according to claim 1, wherein said polymeric resin is dissolvable or dispersible in a liquid carrier.

8. The fibrous material according to claim 1, wherein said radiation energy for impacting on said polymeric resin is selected from the group consisting of UV, IR light, and mixtures thereof.

9. The fibrous material of claim 1 wherein the fibrous material is in the form of a fibrous aggregate.

10. The fibrous material according to claim 9 further comprising at least two preselected regions of different degrees of cross-linked radiation activatable polymeric resin.

11. The fibrous material according to claim 9 further comprising at least two preselected regions have a different relative amount of said polymeric resin applied thereto.

12. The fibrous material according to claim 9 wherein said fibrous aggregate is a liquid handling material for use within an absorbent body.

13. A fibrous material according to claim 12 wherein the liquid handling material is for use as an acquisition distribution material in an absorbent body.

14. A fibrous material comprising cellulosic fibers, wherein said fibers comprise a polymeric resin comprising covalently bonded radiation reactive groups capable of forming cross-linking bonds upon being impacted by radiation energy and said fibers comprise a second cross-linking material capable of forming cross-linking bonds without being impacted by radiation energy.

15. The fibrous material according to claim 14, wherein said second cross-linking material is selected from the group consisting of aldehyde and urea-based formaldehyde, carboxylic acid, preferably C2–C9 polycarboxylic acids that contain at least three carboxyl groups, preferably from the group consisting of citric acid, tartaric acid, malic acid, succinic acid, glutaric acid, itaconic acid, tartrate monosuccinic acid, maleic acid, poly(acrylic acid), poly(roethacrylic acid), poly(maleic acid), poly(methylvinylether-co-maleate) copolymer, poly(methylvinyl ether-co-itaconate copolymer, copolymers of acrylic acid, copolymers of maleic acid, and mixtures thereof.

16. The fibrous material according to claim 14 wherein said cross-linking is between cellulose molecules of the same or different cellulosic fibers.

17. Method for treating cellulosic fibers, said method comprising the steps of:

providing cellulosic fibers;

applying a radiation activatable resin to said fibers;

forming fiber aggregates from the resin coated fibers;

curing of said radiation activatable resin.

18. Method according to claim 17, further comprising one or more process steps selected from the group consisting of forming an intermediate web and disintegrating the intermediate web; applying a non-radiation activatable cross-linking material and curing of said non-radiation activated cross-linking material; or transporting said fibers, web, or aggregate.

19. The method according to claim 18, wherein one or more steps is repeated.

20. The method according to claim 17, wherein said radiation activatable resin is selectively applied to a predetermined region of the formed fiber aggregate.

21. The method according to claim 17, wherein the curing of the radiation activatable resin is selectively applied to a predetermined region of the formed fiber aggregate.

22. The method according to claim 17, wherein said radiation activatable resin is activated by exposure to UV radiation.

23. The method according to claim 17, wherein said radiation activatable resin is applied at preselected varying intensity at preselected different regions of the formed fiber aggregate.

24. A fibrous material comprising cellulosic fibers wherein said fibers have been treated according to claim 17.

* * * * *

UNITED STATES PATENT AND TRADEMARK OFFICE

CERTIFICATE OF CORRECTION

PATENT NO. : 6,887,347 B2
APPLICATION NO. : 10/730659
DATED : May 3, 2005
INVENTOR(S) : Ekaterina Ponomarenko et al.

It is certified that error appears in the above-identified patent and that said Letters Patent is hereby corrected as shown below:

Column 4

Line 61, delete “dimethylamino4” and insert -- dimethylamino-4 --.

Signed and Sealed this

Eighteenth Day of December, 2007

JON W. DUDAS
*Director of the United States Patent and Trademark Office*